United States Patent [19]

Minor

[11] 4,231,453

[45] Nov. 4, 1980

[54] COMBINED BOX, TABLE AND BENCH

[76] Inventor: William F. Minor, 3614 N. Kilpatrick, Chicago, Ill. 60641

[21] Appl. No.: 962,374

[22] Filed: Nov. 20, 1978

[51] Int. Cl.[3] ..... A45F 4/00; A47B 3/10

[52] U.S. Cl. ..... 190/11; 217/12 R; 220/4 F

[58] Field of Search ..... 190/11, 12 A; 108/34, 108/35; 217/12 R, 16; 220/4 F

[56] References Cited

U.S. PATENT DOCUMENTS

| | | | |
|---|---|---|---|
| 1,492,854 | 5/1924 | Larsen | 190/11 |
| 1,626,293 | 4/1927 | Mason | 108/34 |
| 2,119,799 | 6/1938 | Siney | 220/4 F |
| 2,258,364 | 10/1941 | Maxwell | 190/11 |
| 4,034,518 | 7/1977 | Trecker | 190/11 |

FOREIGN PATENT DOCUMENTS

| | | | |
|---|---|---|---|
| 482638 | 1/1917 | France | 190/11 |
| 438812 | 8/1948 | Italy | 190/11 |
| 280128 | 4/1952 | Switzerland | 190/11 |
| 167855 | 8/1921 | United Kingdom | 190/11 |

*Primary Examiner*—Herbert F. Ross

*Attorney, Agent, or Firm*—Laff, Whitesel & Rockman

[57] ABSTRACT

A box is designed in a size and shape which is convenient for holding any suitable equipment, such as camping and picnicking equipment and including such things as a tent and perhaps some simple cooking implements. The box has six panels which fit together in one manner to form a box and in another manner to form a table, which might be a picnic table, a bench and two spools, for example. When the panels are assembled in yet another manner, they form a compact luggage-type unit for easy carrying. A feature of the invention is that all parts are reusable and that the various configurations fit into preexisting geometrical constraints such as the trunks of cars, and the like.

7 Claims, 17 Drawing Figures

COMBINED BOX, TABLE AND BENCH

This invention relates to boxes, table and benches, for any suitable use such as picnic and camp gear and, more particularly, to tables which knock down either to form a box for enclosing and carrying equipment or to assemble compactly for easy hand-carrying.

Campers and picnickers, by way of example, face traditional problems of transporting substantial amounts of equipment, usually when transportation space is minimal. There is a need for a tent, sleeping equipment, food, cooking equipment, a picnic table, seats, and the like. In general, this type of equipment requires substantial amounts of room and tends to push out other things which are also needed, such as clothes, personal effects, and the like. As autos are down-sized to meet national energy-saving standards, the space problems are exacerbated.

Knock-down tables, boxes, and the like, have many other uses such as convenient storage for persons living in limited spaces such as small city apartments. Therefore, the references herein to picnicking, camping, and the like, are to be construed broadly enough to cover all suitable uses.

Accordingly, an object of the invention is to provide new and improved convenience furniture, such as camping and picnic gear, small apartment furnishings, and the like. In particular, an object is to provide minimum size equipment which performs many different optional functions.

Another further object is to provide a picnic table, bench or stools made from separate panels which may be reassembled into a box. Still another object is to provide these features in an arrangement which may fit into the trunk or on a roof carrier of a small car. A more specific object is to provide a knock-down table, a bench and two stools. A further object is to enable the table panels to be reassembled into an easy carrying luggage type of configuration.

Another object of the invention is to provide the above-described equipment which has a minimum number of parts giving a maximum number of different uses.

Still another object of the invention is to provide equipment of the described type which may be manufactured from low-cost, readily available, trouble-free materials which are not damaged or destroyed by the elements.

In keeping with an aspect of the invention, these and other objects are accomplished by providing a box having four side panels and two end panels which may be reassembled in a number of different configurations to form a table with a separate bench and two separate stools, an easy-to-carry luggage item, and the like. When the panels are assembled into the box form, it may be used to package a substantial amount of gear. Still, the box is small enough to fit into the trunk of a small car or to be carried on a roof carrier. Suitable shoulder straps may be provided for backpacking, or handles may be provided for luggage type of carrying. Exemplary of the uses of the invention may be a picnic table or a box to carry camping equipment such as a tent large enough to sleep eight people, for example. Still, in the luggage configuration, it is small enough to be stored in a closet or under a small bed.

A preferred embodiment of the invention is shown in the attached drawings, wherein.

Figure 12:
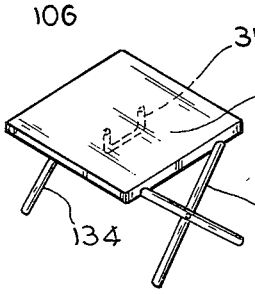
Figure 9:
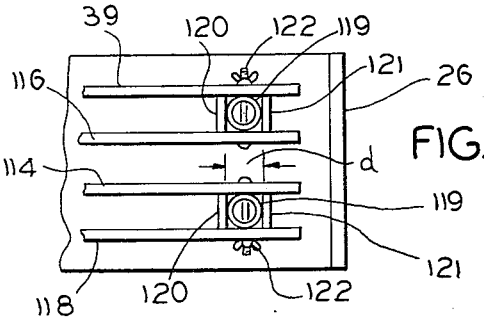
FIG. 9 is a plan view which shows an end of the bench of FIG. 8 with the supporting legs in place.
Figure 11:
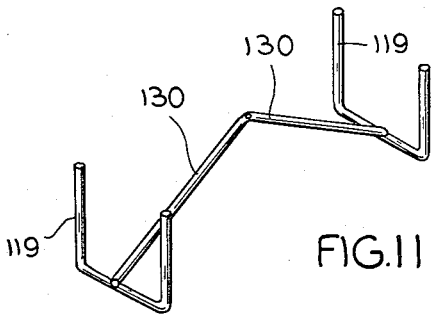
Figure 13:
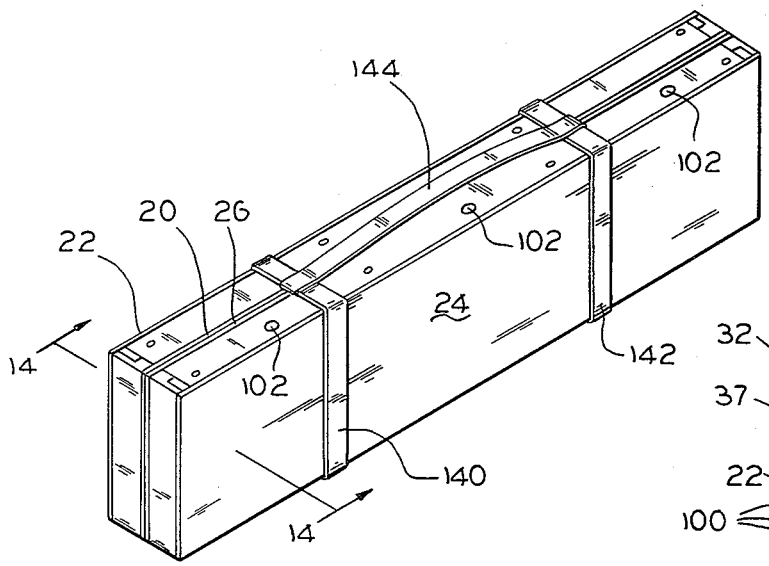
Figure 14:
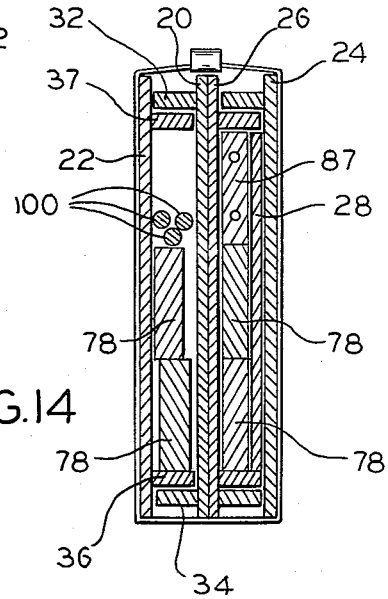
Figure 15:
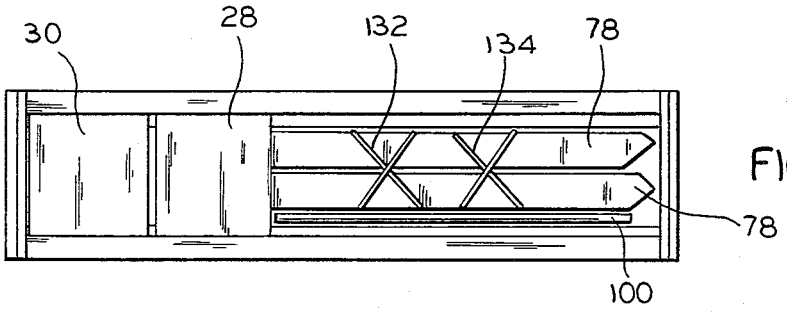
Figure 16:
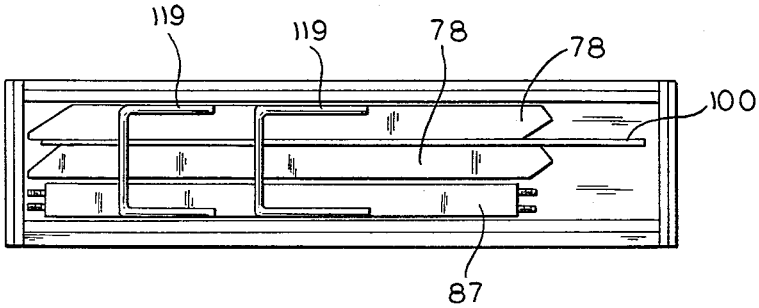

FIG. 11 schematically shows how the legs are supported on the bench when they are hinged thereto;

FIG. 12 is a perspective view showing of a stool made from the end panel;

FIG. 13 is a perspective view of the panels assembled into a luggage type of configuration;

FIG. 14 is a cross section taken along line 14—14 of FIG. 13;

FIG. 15 is a plan view of one side of the luggage configuration showing the parts enclosed therein; and FIG. 16 is a similar plan view of the other side.

The invention utilizes six panels which may be configured for making a box when assembled in one way, to form a luggage-type package when assembled in another way, and to form a table, bench and stools when assembled in yet another way. These six panels include two sides, a top and a bottom 20,22,24,26, and two ends 28,30. If desired, handles (such as 31) may be formed on each end panel 28,30, to assist in carrying the box. Each of these panels is completely separate (e.g., not hinged together) from the others so that the box may be disassembled into six completely separate panels.

Figure 2:
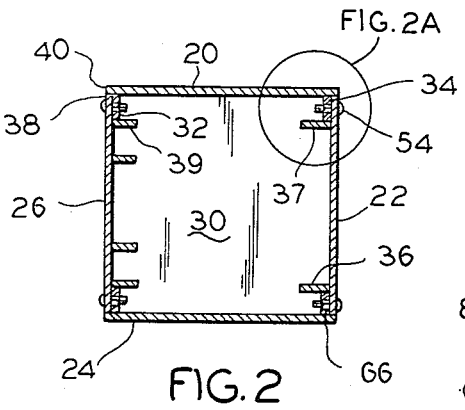
FIG. 2 is a cross-sectional view of the box of FIG. 1, taken along line 2—2, thereof.

Each of these box panels may have a suitable number of reinforcing strips or stringers associated therewith to strengthen the panels, to enable the panels to fit into the other panels, and to provide anchor points for securing together the associated parts when used in the various configurations. More particularly, as seen in FIG. 2, each of the side and top panels has a pair of longitudinal stringers, as shown at 32,34,36,37 (for example), which strengthen the load-bearing qualities of the panels. Also, the stringers are positioned so that each abuts against an adjacent one in the various configurations. Thus, for example, the stringers 32,34 are part of and integral with the panel 20, while the stringers 36,37 are part of and integral with the panel 22. For example, the stringer 32 (on panel 20) abuts against the underside of panel 26 and against the adjacent stringer 39 (on panel 26). The space between stringer 39 and the edge 38 of the panel 26 is exactly equal to the width of the stringer 32. The space between the edge 40 of the panel 20 and stringer 32 is exactly equal to the thickness of the side 26. Therefore, when the panel 20 is set next to the panel 26, the adjacent stringers and panels abut against and nest with each other. By inspection of the panels in the box configuration (FIG. 2), it is seen that each of the corners fit together in essentially the same manner.

Figure 2A:
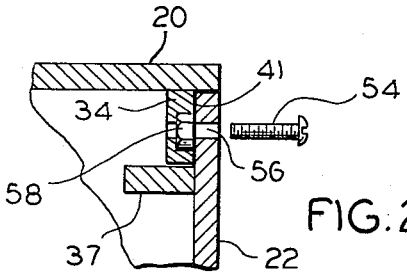
FIG. 2A is an enlargement of that portion of FIG. 2 which is enclosed by a circle.

If desired, weather stripping may be positioned in the space where the panels fit together to form the box configuration. This weather stripping is indicated in FIG. 2A by heavily inked line 41. In another embodiment, the various panels and stringers may be formed with lips or edges which tend to weatherproof the box. This other embodiment is especially attractive when the panels are made from a molded plastic material. Similar weather stripping, lips, edges, or the like, may be provided at the perimeters of all of the panels, including the end panels 28,30. This weather stripping may be made from any suitable material such as rubber or a rubber-like plastic which is cemented to or embedded in the stringers and panel edge regions. When these weather strippings are sufficiently squeezed by an assembly of the box, it is completely weatherproofed so that it may be simply attached to a roof carrier of an auto and carried at highway speeds without further protection from the elements.

Figure 3:
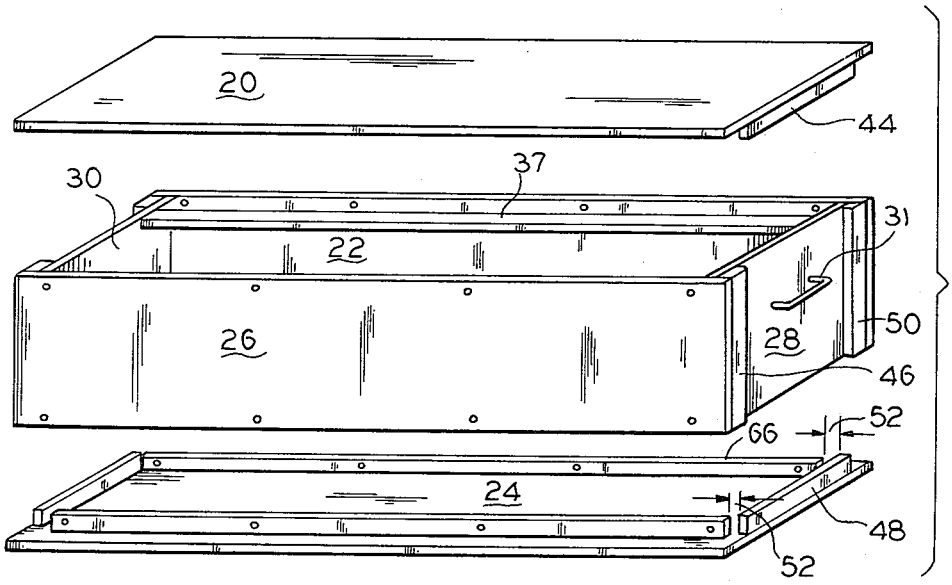
FIG. 3 is a partially-exploded view of the inventive box.

As seen in FIG. 3, two panels have been removed from the box to reveal the internal construction. It will be observed that on each end of the four long panels 20,22,24,26, there is a cleat, as seen at 44,46,48,50. The spaces 52 between each of the cleats and the ends of the associated stringers are equal to the thickness of the end panels 28,30. Thus, when two of the long panels 20,22 (for example) are positioned over another long panel 26, the end panel 28 may be slipped into the spaces 52 between the ends of the stringers and the associated cleats. When the panel 20, for example, is placed on top of the box (as viewed in FIG. 3), the top edge of end panel 28 fits into the spaces corresponding to 52 on the top panel, thereby completing the box.

Figure 1:
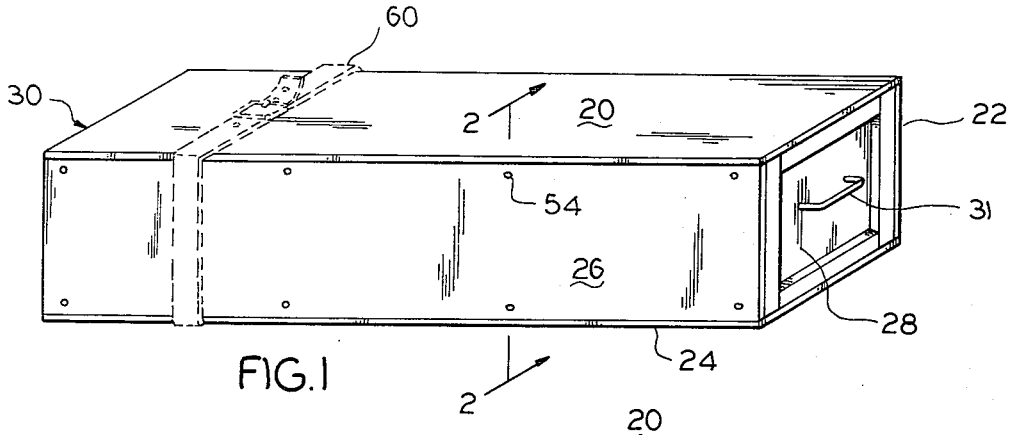
FIG. 1 is a perspective view of a closed form of the box.

Once the six sides of the box are in position, they may be held in place by any suitable means. For example, a threaded hole or nut may be molded or pressed (depending upon the material used) into a stringer or panel at each desired anchor point, such as nut 58, FIG. 2A, for example. Other fasteners may include quarter-turn fasteners, cams, lever-controlled devices, and the like. Bolt 54 (FIG. 1) may fit through a mating hole 56 in the panel abutting against the threaded hole or nut in the stringer 34. The bolts may have either a screwdriver slot or a head (such as wings) which may be tightened by finger pressure and, therefore, would not require tools. In like manner, any suitable number of bolts and associated embedded nuts or otherwise threaded holes may be used to fasten the box together. If desired, a web belt 60 (or the like) may be used at either end of the box either in lieu of or in addition to the bolts 54, in order to secure the box together. If desired, these belts 60 may be part of a backpacking harness for carrying the box.

Inside the box are pieceparts which may be used to assemble the panels 20,22,24,26 into a picnic table and a bench. The end panels 28,30 may be converted into two stools. Preferably, these pieceparts have dimensions which fit comfortably into the space within the areas bounded by the panels and stringers, regardless of the configuration of the panels. For example, at least some of these pieceparts might be attached to the inside surface of a particular panel (such as 20, FIG. 2) and in the area between the stringers 32,39,34,37. Similarly, these pieceparts might also be attached to the inside surface of the panel 22. An advantage of such an attachment is that the parts do not rattle. In usage where rattling is irrelevant, these parts may be placed loosely in the box.

Figure 4:
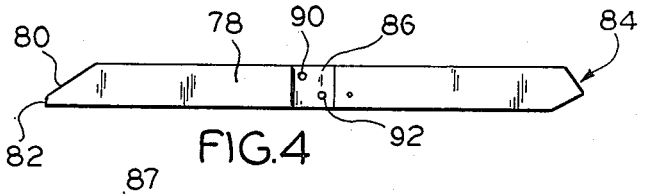
FIG. 4 is a plan view of one of four members which may be assembled into cross-bucks, to form legs of or a support for a table.
Figure 5:
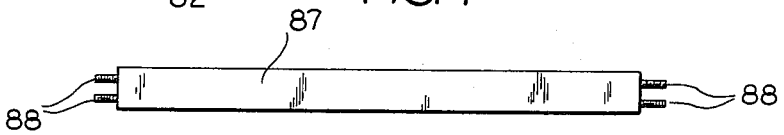
FIG. 5 is a plan view of a fifth member which is used to complete the table support.
Figure 6:
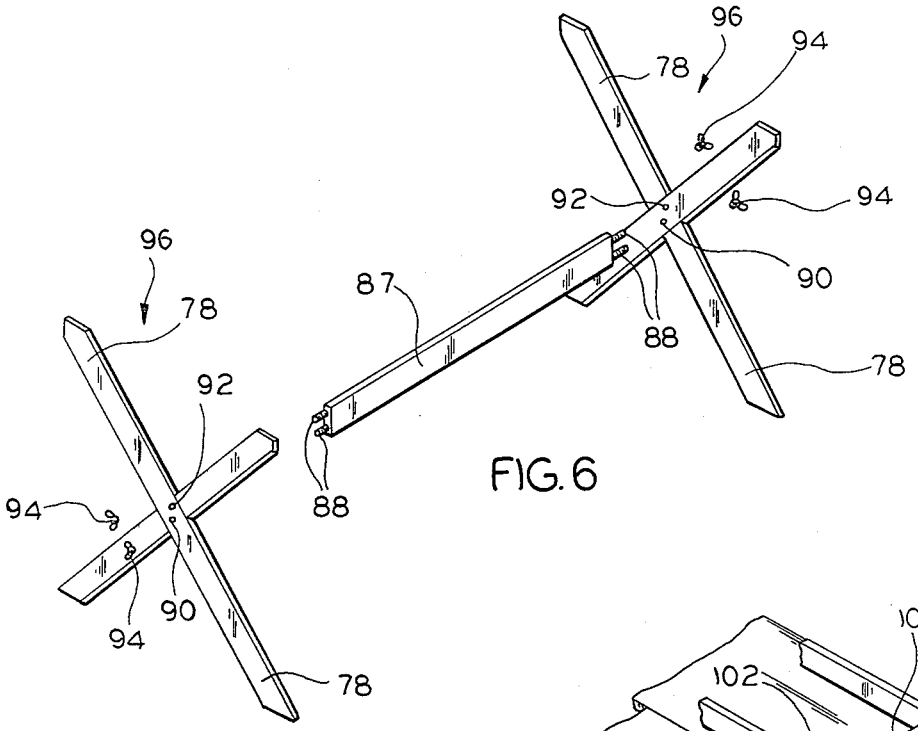
FIG. 6 is an exploded view of the parts used to complete the means for supporting the table top.

FIGS. 4–6 are plan views and an exploded view of those pieceparts which are assembled and used to support the picnic table. More particularly, FIG. 4 is a plan view of a first type of piecepart 78 which may be duplicated to provide four cross-buck legs. The opposite ends of leg 78 are cut at a bias to rest upon and against flat surfaces after the cross-bucks are assembled. The relatively long end 80 is generally flat along the entire width of the leg to rest upon the ground or a floor. The point 82 is generally rounded to make it stronger at the tip and to prevent it from digging into surfaces which it may contact. The opposite end 84 has a generally angular shape so that it fits against the flat undersurface of the table and against an inside surface of a stringer. Near the central region of the leg 78, there is a countersunk or cutout portion 86 which receives a corresponding and similar countersunk portion of an adjacent leg. These countersunk portions fit together to brace against each other and to make a fairly rigid X-shaped configuration.

Another piecepart of the cross-buck assembly is shown in FIG. 5 as a generally rectangular centerpiece or cross member 87 having two spaced parallel bolts 88 projecting longitudinally from each end. These bolts are spaced apart far enough so that they fit through two bolt holes 90,92 formed in the countersunk region 86.

As seen in FIG. 6, four of the legs 78 fit together, in pairs, to form two generally X-shaped, cross-buck structures. The bolt holes 90,92 in the countersunk regions align when the two legs of each pair are properly positioned in their X-shaped position. After the two pairs of legs are aligned, the bolts 88 on each end of the centerpiece or cross member 87 are fitted therethrough. Then, a wing nut 94 is turned onto the protruding end of each of the bolts 88.

Figure 7:
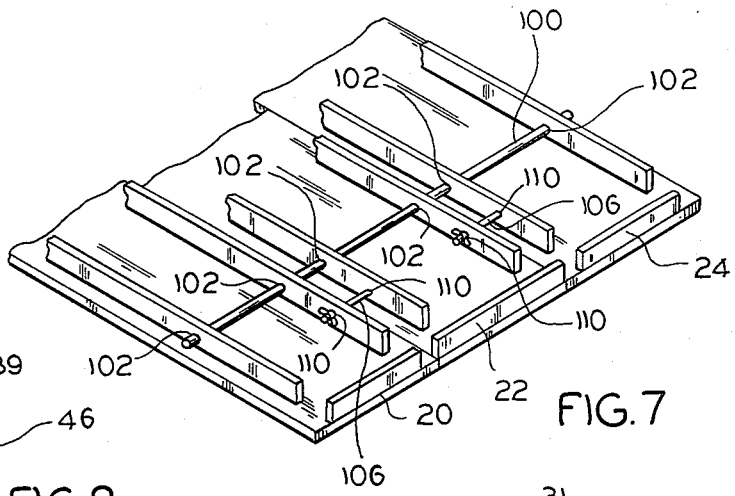
FIG. 7 is a fragmentary end view which shows how three side panels of the box are assembled to form a table top.

To assemble the tabletop, three of the panels 20,22,24 (FIG. 7) are laid side by side in both horizontal and longitudinal alignment. A plurality of dowels 100 are inserted through aligned holes 102 permanently formed in the stringers. A number of fasteners, such as bolts 106 are fitted through holes 110 and secured in place. These holes 110 are the same holes, with threaded fasteners therein, which are used to assemble the panels into its other configurations, such as the box form of FIG. 1. Conveniently, these bolts have wing-nut heads, or the equivalent, so that they may be turned by fingers without requiring tools. Also, other suitable fasteners such as quarter-turn fasteners, cams, lever-type devices, or the like, may be used. A nut, keeper, or the like, may be molded or embedded in a stringer to receive the end of the bolt, or other fastener. These fasteners 106 hold the adjacent panels in place, next to each other, so that they cannot thereafter separate. The joined panels 20,22,24 are next inverted and set on top of the ends 84 of the cross-buck legs 78.

Figure 8:
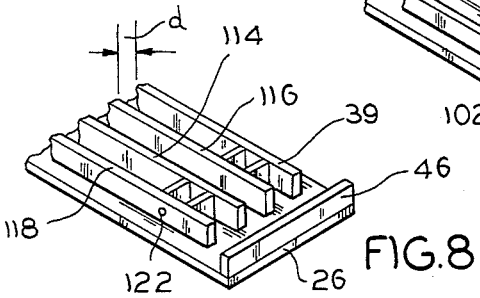
FIG. 8 is a fragmentary end view of a box panel which is configured to form a bench seat.
Figure 10:
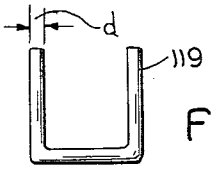
FIG. 10 is a plan view of a leg section for the bench part of the equipment.

One of the long box panels 26 (FIG. 8) preferably has two extra stringers 114,116 formed thereon, for added strength. However, this need for extra stringers depends upon the material being used to make the panel. These added stringers 114,116 are spaced parallel away from and confronting to the stringers 39,118 by a distance d, which is approximately equal to the diameter or thickness d (FIG. 10) of a leg 119 used to support the bench. An exemplary U-shaped bench leg 119 (FIG. 10) represents one of several configurations which could be used. A pair of blocks or supports 120,121 are fastened crossways between each confronting pair of the stringers 39,116 and 114,118. The blocks 120,121 are separated from each other by the distance d which is equal to the diameter d of the leg 119. Thus, the two upper ends of the U-shaped leg 119 fit into the sockets formed jointly by the stringers and blocks. Suitable bolts 122 may pass in holes in the stringers and through the ends of the leg 119 to hold it in place. A similar leg is attached to the other end of panel 26 to form a picnic bench.

If the blocks 120 are omitted in each pair, the leg 119 may pivot on bolts 122 to fold up against the underside of panel 26 for storage or down for use. If such a pivoting leg is used, a hinged diagonal brace 130,130 (FIG. 11) may run from near the bottom of each leg 119 to a point near the center of the bench panel 26, thereby providing greater lateral stability.

By a slight modification of the design of the crossbuck legs of FIGS. 4 and 6, a pair of three-legged tripods may be assembled to horizontally receive, on their tops, the panels 28,30, in order to form a pair of stools. Or, alternatively, as shown in FIG. 12, a pair of generally X-shaped legs 132,134 may be attached to each of the end pieces 28,30 in order to form separate stools.

FIGS. 13–16 show yet another configuration of the long panels 20,22,24,26 which enables them to be bundled into a minimum bulk and then easily carried, much as luggage is carried. More particularly, the stringers 32,34 on panel 20 embrace the stringers 37,36 on panel 22 when the two panels 20,22 are brought together in a face-to-face relationship. Likewise, there is a similar geometrical relationship when the two panels 24,26 are brought together.

In each of these paired panels, the stringers hold their associated panels far enough apart to provide an enclosed space for receiving the disassembled table parts. For example, FIGS. 14–16 have been drawn to show that four legs 78, centerpiece or cross member 87, end panels 28,30, stool and bench legs 119,119,132,134, and a suitable number of dowels 100 are enclosed in these spaces. Provisions may also be made in the spaces between the panels for receiving a suitable number of bolts 106, and the like.

After the four long panels 20,22,24,26 are assembled in a face-to-face confrontation with the pieceparts stored between them, as shown in FIGS. 14–16, a pair of web belts 140,142 are strapped around them. A handle 144 runs from strap 140 to strap 142. Therefore, the total assembly of all parts may be formed into a luggage-type configuration so that it may be carried as a suitcase is carried. As shown in FIG. 2, the confronting edges of the panels may also be weather-stripped to maintain a weatherproofed interior when the panels are assembled into the luggage-type configuration of FIG. 11.

Those who are skilled in the art will readily perceive how to modify the system. Therefore, the appended claims are to be construed to cover all equivalent structures which fall within the true scope and spirit of the invention.

I claim:

1. A multi-purpose box comprising a plurality of separate panel means having edges formed to nest together when the panel means are assembled in one configuration to form sides and ends of a box and when assembled in another configuration to form a compact luggage-type device, wherein said panel edges comprise stringers running longitudinally along the length of said panels, means for attaching said panels together to secure them in either of said configurations, means for securing together a plurality of said panels in a side-by-side, horizontally-aligned relationship to form a tabletop, and a plurality of separate part means which may be secured together to form at least a means for supporting said tabletop, said separate part means fitting inside space defined by said panels when assembled in either of said configurations.

2. The box of claim 1 and means formed along surfaces where said panels fit together in order to form a weather-tight configuration.

3. The box of claim 1 wherein said means for securing the panels in said side-by-side, horizontally-aligned relationship comprises a plurality of dowels passing through aligned holes in said stringers and means for attaching said panels together.

4. The box of claim 1 and leg means for attaching to said stringers of at least one of said panels for forming said one panel into a bench.

5. The box of claim 1 and strap means for securing said panels in said other and luggage configuration.

6. The box of claim 1 and strap means for securing said panels in either of said configurations, said strap means forming at least part of a backpacking carrying means.

7. A multi-purpose device comprising six parallel completely separate panel means having stringers along edges formed to nest together to form a box when the panel means are assembled in one configuration, and to form a compact luggage-type device. With said stringers functioning to hold said panels in spaced parallel relationship when in said luggage configuration, means for attaching said panels together to secure them in a side-by-side, horizontally-aligned relationship to form a tabletop, and a plurality of part means which may be secured together to form at least a means for supporting said tabletop, said part means fitting inside space defined by said spaced parallel panels when assembled in said luggage-type configuration.

* * * * *